US006036105A

United States Patent [19]

Sanada et al.

[11] Patent Number: 6,036,105

[45] Date of Patent: Mar. 14, 2000

[54] LIQUID SPRAYING APPARATUS AND A METHOD OF MANUFACTURING THE LIQUID SPRAYING APPARATUS

[75] Inventors: Kazuo Sanada; Hiroshi Inoue, both of Kanagawa, Japan

[73] Assignee: Fuji Photo Film Co., Ltd., Kanagawa, Japan

[21] Appl. No.: 09/032,759

[22] Filed: Feb. 27, 1998

[30] Foreign Application Priority Data

Mar. 4, 1997 [JP] Japan ..... 9-049341
Aug. 20, 1997 [JP] Japan ..... 9-223530

[51] Int. Cl.[7] ..... B05B 1/28; B05B 1/08; B41J 2/135; B41J 2/045

[52] U.S. Cl. ..... 239/104; 239/102.1; 239/102.2; 347/45; 347/47; 347/70

[58] Field of Search ..... 239/104, 102.1, 239/102.2; 347/45, 70, 71, 40, 47

[56] References Cited

U.S. PATENT DOCUMENTS 4,605,167 8/1986 Maehara ..... 239/102.2
5,574,530 11/1996 Sanada ..... 347/68 X

*Primary Examiner*—Andres Kashnikow
*Assistant Examiner*—Robin O. Evans
*Attorney, Agent, or Firm*—Sughrue, Mion, Zinn, Macpeak & Seas, PLLC

[57] ABSTRACT

A liquid spraying apparatus according to the present invention comprises a spray tank which stores an image forming solvent, a nozzle plate which is provided as a portion of the wall surface of the spray tank, and has a plurality of nozzle holes formed thereon for spraying the image forming solvent, and which can spray the image forming solvent from the plurality of nozzle holes through a reciprocating movement, and a water repelling layer which is provided on the internal periphery of the nozzle holes of the nozzle plate and repels the image forming solvent.

28 Claims, 13 Drawing Sheets

322
366
322A
324
368
K
366

LIQUID SPRAYING APPARATUS AND A METHOD OF MANUFACTURING THE LIQUID SPRAYING APPARATUS

BACKGROUND OF THE INVENTION

1. Field of the Invention

The present invention relates to a liquid spraying apparatus which can spray an image forming solvent appropriately onto an image recording material such as a photosensitive material, an image recording material or the like, and to a method of manufacturing the liquid spraying apparatus.

2. Description of the Related Art

An image forming apparatus which effects an image recording process by using two types of image recording materials including, for example, a photosensitive material and an image receiving material has been known.

Inside this type of image forming apparatus, an image forming solvent application section having a tank for storing image forming solvent to apply to the photosensitive material is disposed. Further, a heat developing and transferring section comprising a heat drum and an endless press-contact belt, which is pressed into contact with the outer circumference of the heat drum and, rotated together with the heat drum.

The photosensitive material onto which an image is exposed, while being nipped and conveyed inside the image forming apparatus, is dipped into a tank storing therein water which is used as an image forming solvent at the image forming solvent application section. After water is applied to the photosensitive material, it is conveyed to the heat developing and transferring section. The image receiving material is also conveyed to the heat developing and transferring section, in the same manner as the photosensitive material.

In the heat developing and transferring section, the photosensitive material which has been subjected to water application is laminated with the image receiving material. In this laminated state, the photosensitive material is kept into close contact with the outer circumference of the heat drum and is rolled around the heat drum. Further, the photosensitive material and the image receiving material are nipped and conveyed between the heat drum and the endless press-contact belt. The photosensitive material is heat-developed and an image is transferred to the image receiving material, and a predetermined image is formed (recorded) on the image receiving material.

However, when the photosensitive material is dipped in a tank storing therein water as an image forming solvent and this water is applied to the photosensitive material, the water which has already been in contact with the photosensitive material consequently ends up remaining stored in the tank. As a result, bacteria breeds in the tank by taking organic material slightly eluted from the photosensitive material as a nutrient, and the water is thereby soiled. By this, the image forming apparatus itself and the image quality may be deteriorated.

Accordingly, a method in which the water supplying sides of a tank or the like and the photosensitive material do not come into contact with each other, and fine water droplets are sprayed from a sprayer and applied to the photosensitive material by vibrating a nozzle plate having a plurality of nozzle holes has been thought of.

However, at times when the sprayer is filled with water, such as when it is first used, the water pressure inside the sprayer may be in a higher positive pressure state than the outside air pressure. For this reason, since the nozzle holes which spray the water droplets cannot operate as valves to stem the flow of water, there is the concern that water may leak from the nozzle holes

SUMMARY OF THE INVENTION

In view of the aforementioned facts, it is an object of the present invention to provide a liquid spraying apparatus and a method of manufacturing the liquid spraying apparatus in which unnecessary leakage of an image forming solvent from the nozzle holes can be prevented.

In accordance with a first aspect of the present invention, there is provided a liquid spraying apparatus comprising a spray tank in which an image forming solvent is stored, a nozzle plate which is disposed on the spray tank as a portion of the wall surface of the spray tank and has a plurality of nozzle holes formed thereon for spraying the image forming solvent, and which can spray the image forming solvent from the plurality of nozzle holes in a reciprocating movement, and a water repelling layer which is provided at the internal periphery of the nozzle holes of the nozzle plate for repelling the image forming solvent.

In accordance with a second aspect of the present invention, there is provided a liquid spraying apparatus according to the first aspect of the present invention in which the water repelling layer is further provided on the periphery of the nozzle holes of the nozzle plate on the external side of the spray tank.

In accordance with a third aspect of the present invention, there is provided a liquid spraying apparatus according to the second aspect of the present invention in which the water repelling layer is further provided on the periphery of the nozzle holes of the nozzle plate on the internal side of the spray tank.

In accordance with a fourth aspect of the present invention, there is provided a liquid spraying apparatus comprising a spray tank in which an image forming solvent is stored, a nozzle plate which is provided on the spray tank as a portion of the wall surface of the spray tank and has a plurality of nozzle holes formed thereon for spraying the image forming solvent, and a water repelling layer which is provided at the internal periphery of the nozzle holes of the nozzle plate and repels the image forming solvent, and an actuator by which the nozzle plate is reciprocated.

In accordance with a fifth aspect of the present invention, there is provided a liquid spraying apparatus according to the fourth aspect of the present invention in which the water repelling layer is further provided on the periphery of the nozzle holes of the nozzle plate on the external side of the spray tank.

In accordance with a sixth aspect of the present invention, there is provided a liquid spraying apparatus according to the fifth aspect of the present invention in which the water repelling layer is further provided on the periphery of the nozzle holes of the nozzle plate on the internal side of the spray tank.

In accordance with a seventh aspect of the present invention, there is provided a method of manufacturing a liquid spraying apparatus in which a nozzle plate having a plurality of nozzle holes formed thereon for spraying an image forming solvent is provided as a portion of the wall surface of the spray tank comprising the steps of making a nozzle plate having a plurality of nozzle holes formed thereon, and providing a water repelling layer which repels an image forming solvent by flushing a plating liquid in circulation inside the nozzle holes of the nozzle plate, and effecting a plating process on the internal periphery of the nozzle holes.

The operation of the liquid spraying apparatus according to a first aspect of the present invention will now be explained.

An image forming solvent is stored in a spray tank. For example, the spray tank is disposed so as to oppose the conveying direction of an image recording material. A nozzle plate having a plurality of nozzle holes formed thereon for spraying the image forming solvent is provided on the spray tank as a portion of the wall surface thereof opposing the conveying direction of the image recording material. The image forming solvent is sprayed from the plurality of nozzle holes during a reciprocating movement of the nozzle plate. Further, a water repelling layer is provided at the internal periphery of the nozzle holes of the nozzle plate in order to repel the image forming solvent.

Accordingly, because a water repelling layer for repelling an image forming solvent is provided at the internal periphery of the nozzle holes of the nozzle plate which is provided as a portion of the wall surface of the spray tank, when the hydraulic pressure of the image forming solvent in the spray tank exhibits positive pressure, the nozzle hole can operate as a valve which repels and dams the image forming solvent. As a result, the image forming solvent is prevented from leaking unnecessarily from the nozzle holes.

The operation of the liquid spraying apparatus according to a second aspect of the present invention will be explained.

The present second aspect provides the same effect as the first aspect of the present invention. However, in accordance with the second aspect, because the water repelling layer is further provided on the periphery of the nozzle holes of the nozzle plate on the external side of the spray tank, the peripheral portion of the nozzle holes can operate as a valve which can repel and dam the image forming solvent. As a result, the image forming solvent is prevented from leaking unnecessarily from the nozzle holes.

The operation of the liquid spraying apparatus according to a third aspect of the present invention will now be explained.

The third aspect provides the same effect as the second aspect of the present invention. However, in this aspect, because the water repelling layer is further provided on the periphery of the nozzle holes of the nozzle plate on the internal side of the spray tank, in the same manner as the second aspect of the present invention, the peripheral portion of the nozzle hole operates as a valve which can repel and dam the image forming solvent. As a result, the image forming solvent is prevented from leaking unnecessarily from the nozzle holes.

The operation of a liquid spraying apparatus according to a fourth aspect of the present invention will now be explained.

The fourth aspect of the present invention provides the same effect as the third aspect of the present invention. However, in accordance with the present aspect, because the nozzle plate is reciprocated by an actuator along a conveying path in a direction so as to approach an image recording material, the image forming solvent stored inside the spray tank is sprayed from a plurality of nozzle holes, so as to accompany the actuator movement.

For this reason, when the actuator is not in use, in the same manner as the first aspect of the present invention, the nozzle holes can operate as valves, and the image forming solvent is prevented from leaking unnecessarily from the nozzle holes.

The operation of the liquid spraying apparatus according to a fifth aspect of the present invention will now be explained.

The fifth aspect provides the same effect as the fourth aspect of the present invention. However, in this aspect, because the water repelling layer is further provided on the periphery of the nozzle holes of the nozzle plate on the external side of the spray tank, the periphery of a nozzle hole can operate as a valve which repels and dams an image forming solvent. As a result, the image forming solvent is prevented from leaking unnecessarily from the nozzle hole.

The operation of the liquid spraying apparatus according to a sixth aspect of the present invention will now be explained.

The sixth aspect provides the same effect as the fifth aspect of the present invention. However, in the present aspect, the water repelling layer is further provided on the periphery of the nozzle holes of the nozzle plate on the internal side of the spray tank. Accordingly, in the same manner as the fifth aspect of the present invention the periphery of a nozzle hole can operate as a valve which repels and dams an image forming solvent. As a result, the image forming solvent is prevented from leaking unnecessarily from the nozzle holes.

The operation of the method of manufacturing a liquid spraying apparatus according to a seventh aspect of the present invention will now be explained.

After a nozzle plate having a plurality of nozzle holes has been formed, the nozzle plate is plated in order to provide a water repelling layer which repels an image forming solvent at the nozzle plate. When this plating process is effected, a plating liquid is flushed into the nozzle holes and a plating layer is provided at the internal periphery of the nozzle holes.

Accordingly, because the plating liquid is flushed into the nozzle holes and circulated, a plating layer which forms the water repelling layer is formed on the internal wall surface of the nozzle holes more reliably and uniformly.

When the plating liquid is left in a nozzle hole without being flushed, new plating liquid does not reach the internal wall surfaces of the nozzle holes, and the formation of a plated layer on the internal wall surface of the nozzle holes becomes a matter of chance. Accordingly, the thickness of the water repelling layer which is formed on the internal wall surface of the nozzle holes is not even. However, in accordance with the present aspect, the water repelling layer can be formed in a more reliable and uniformed manner.

As a result, factors causing the water repelling state of the internal wall surfaces of the nozzle holes on which the plating process has been effected to vary can be eliminated, unnecessary leakage of an image forming solvent from the nozzle holes can be prevented, and the direction of dispersion of the water droplets can be made more stable at the time of atomization.

DESCRIPTION OF THE PREFERRED EMBODIMENTS

Figure 1:
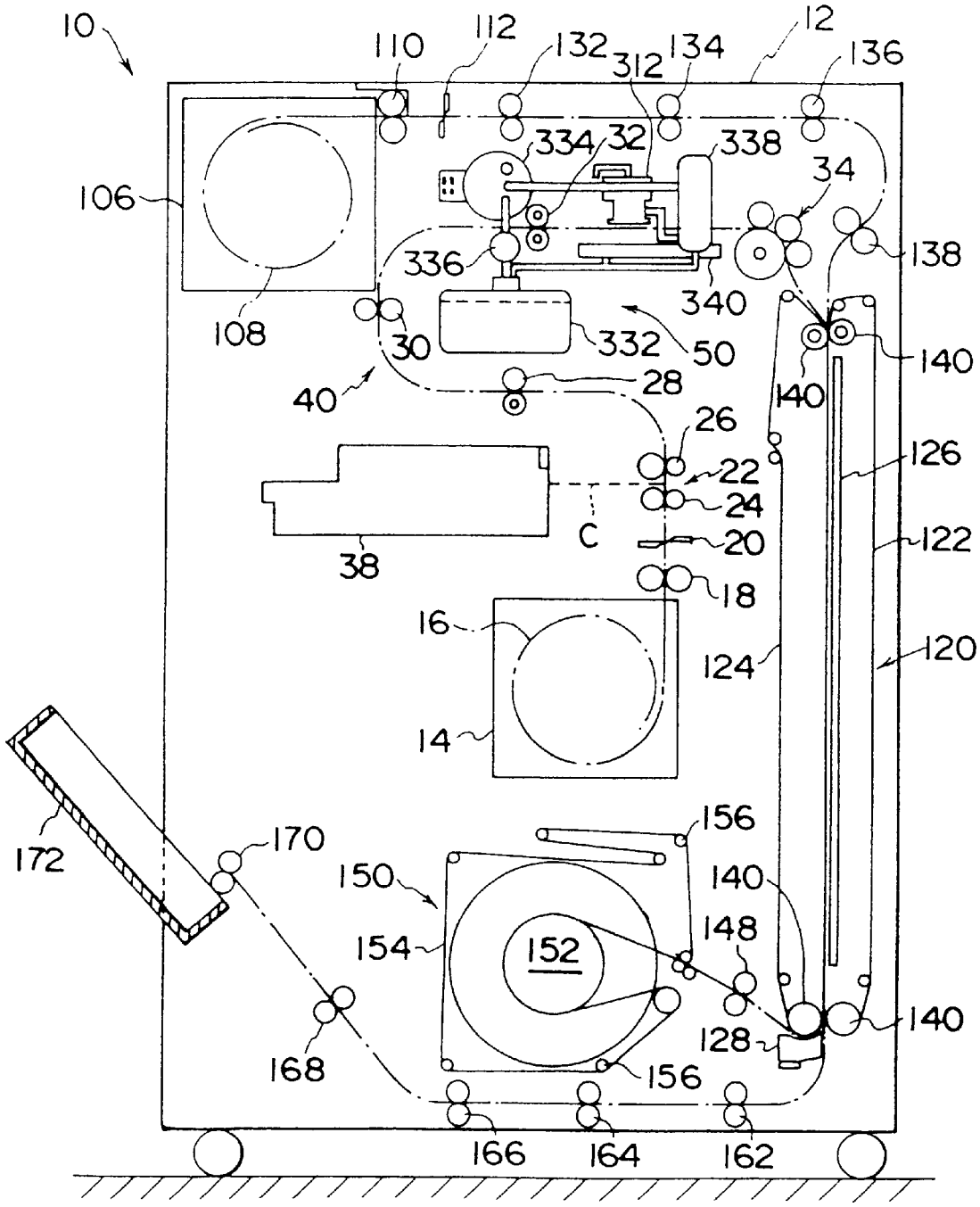
FIG. 1 is a schematic overall view of an image recording apparatus according to an embodiment of the present invention.

FIG. 1 shows a schematic overall structural view of an image recording apparatus 10 serving as an image forming apparatus according to a first embodiment of the present invention.

As shown in FIG. 1, a photosensitive material magazine 14, which receives a photosensitive material 16 therein, is disposed in a housing 12 of the image recording apparatus 10. This photosensitive material 16 is taken up around the photosensitive material magazine 14 in the form of a roll, and the photosensitive (exposure) surface of the photosensitive material 16, which is pulled out from the photosensitive material magazine 14, faces leftward.

Nip roller pairs 18 and a cutter 20 are provided near a photosensitive material output port in the photosensitive magazine 14, and can cut the photosensitive material 16 which has been pulled out to a predetermined length. The cutter 20 is, for example, a rotary type of cutter formed of a moving blade and a stationary blade. The cutter 20 can cut the photosensitive material 16 by vertically moving the moving blade via a rotational cam or the like so as to mesh with the stationary blade.

A plurality of conveying roller pairs 24, 26, 28, 30, 32, 34 are sequentially provided on the downstream side of the cutter 20 in the direction in which the photosensitive material 16 is conveyed. A guide plate (not shown) is provided between each of the conveying roller pairs. The photosensitive material 16 cut to a predetermined length is conveyed firstly to an exposure section 22 provided between the conveying roller pairs 24 and 26.

An exposure device 38 is provided at the left side of the exposure section 22, and three types of LDs, a lens unit, a polygon mirror, and a mirror unit are disposed therein (none of them is shown). A light beam C is transmitted to the exposure section 22 from the exposure device 38 for the photosensitive material 16 to be exposed.

Further, above the exposure section 22, provided are a U-turn portion 40 through which the photosensitive material is conveyed by being curved into a U-shape, and a water application section 50 which applies an image forming solvent to the photosensitive material 16. In accordance with the present embodiment, water is used as an image forming solvent.

The photosensitive material 16, which has come up from the photosensitive material magazine 14 and which has been exposed at the exposure section 22, is nipped and conveyed by each of the conveying roller pairs 28 and 30, and is fed to the water application portion 50 through the conveying path which is close to the upper portion of the U-turn portion 40.

Figure 2:
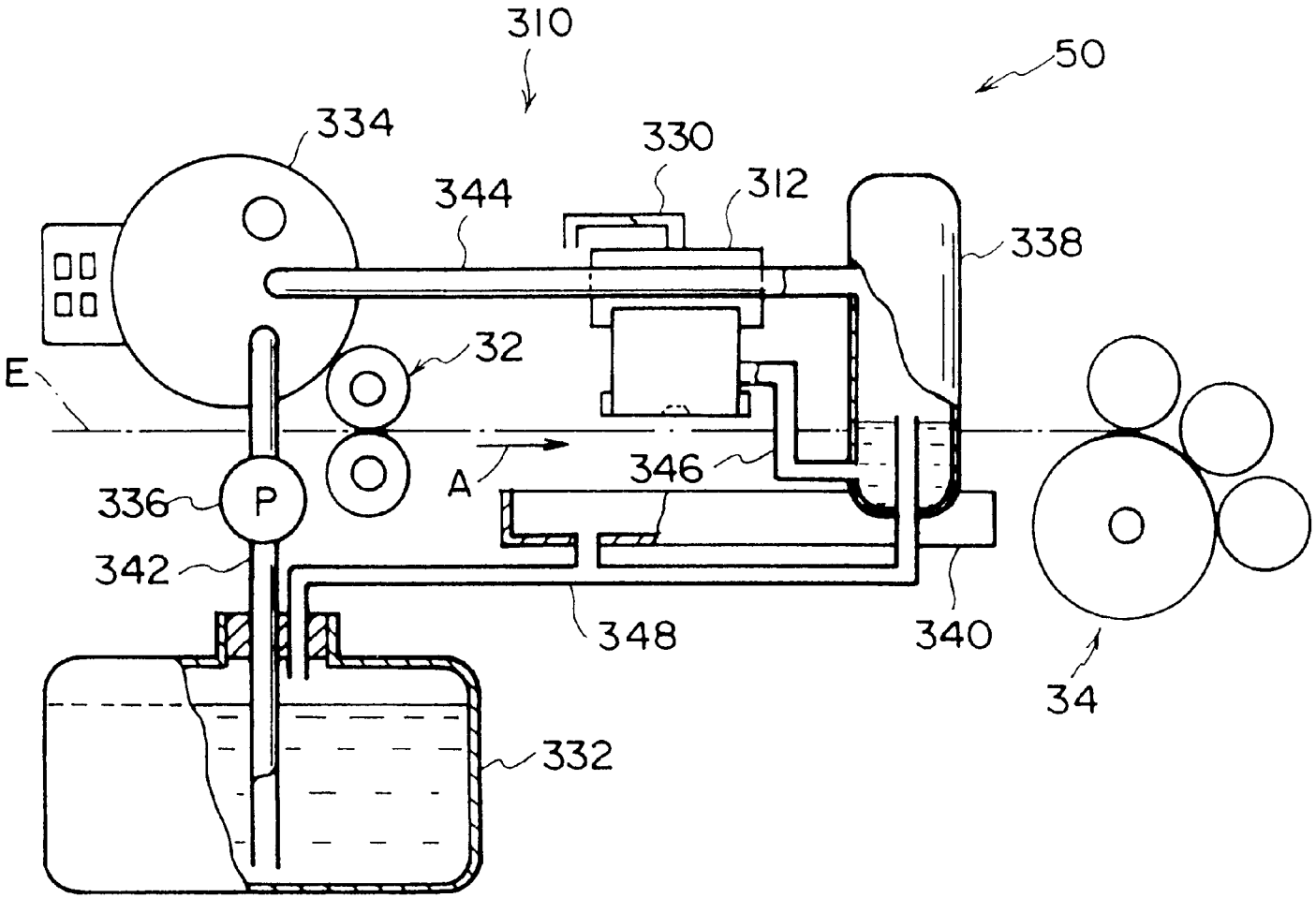
FIG. 2 is a schematic overall view of an application apparatus according to an embodiment of the present invention.

As shown in FIG. 2, a spray tank 312 which forms a part of an application apparatus 310 serving as a liquid spraying apparatus is disposed at a position which is opposite to the conveying path E of the photosensitive material 16 inside the water application section 50.

Further, as shown in FIG. 2, a water bottle 332 for storing the water which is supplied into the spray tank 312 is disposed at the lower left side of the spray tank 312, and a filter 334 for filtering the water is disposed at an upper portion of the water bottle 332. A water supplying pipe 342, which has a pump 336 disposed midway thereof, connects the water bottle 332 and the filter 334.

Further, a sub-tank 338 for storing water which is supplied from the water bottle 332 is disposed at the right side of the spray tank 312, and a water supplying pipe 344 extends from the filter 334 to the sub-tank 338.

Therefore, when the pump 336 is operated, water is supplied from the water bottle 332 to the filter 334, and the water, which has already passed through the filter 334 and been filtered, is supplied into the sub-tank 338 and is temporarily stored therein.

A water supplying pipe 346, which connects the sub-tank 338 and a side end portion of the spray tank 312, is disposed therebetween. The spray tank 312 is filled with water which has been pumped from the water bottle 332 by the pump 336, through the filter 334, the sub-tank 338, the water supplying pipe 346, and the like.

A tray 340, which is connected to the water bottle 332 via a circulation pipe 348, is disposed beneath the spray tank 312. The tray 340 accumulates water overflowing the spray tank 312 and returns the water into the water bottle 332 via the circulation pipe 348. Further, the circulation pipe 348 is connected to the sub-tank 338 in a state where the circulation pipe 348 projects and extends into the sub-tank 338. The circulation pipe 348 returns the excessive water which has been accumulated in the sub-tank 338 into the water bottle 332.

Figure 4:
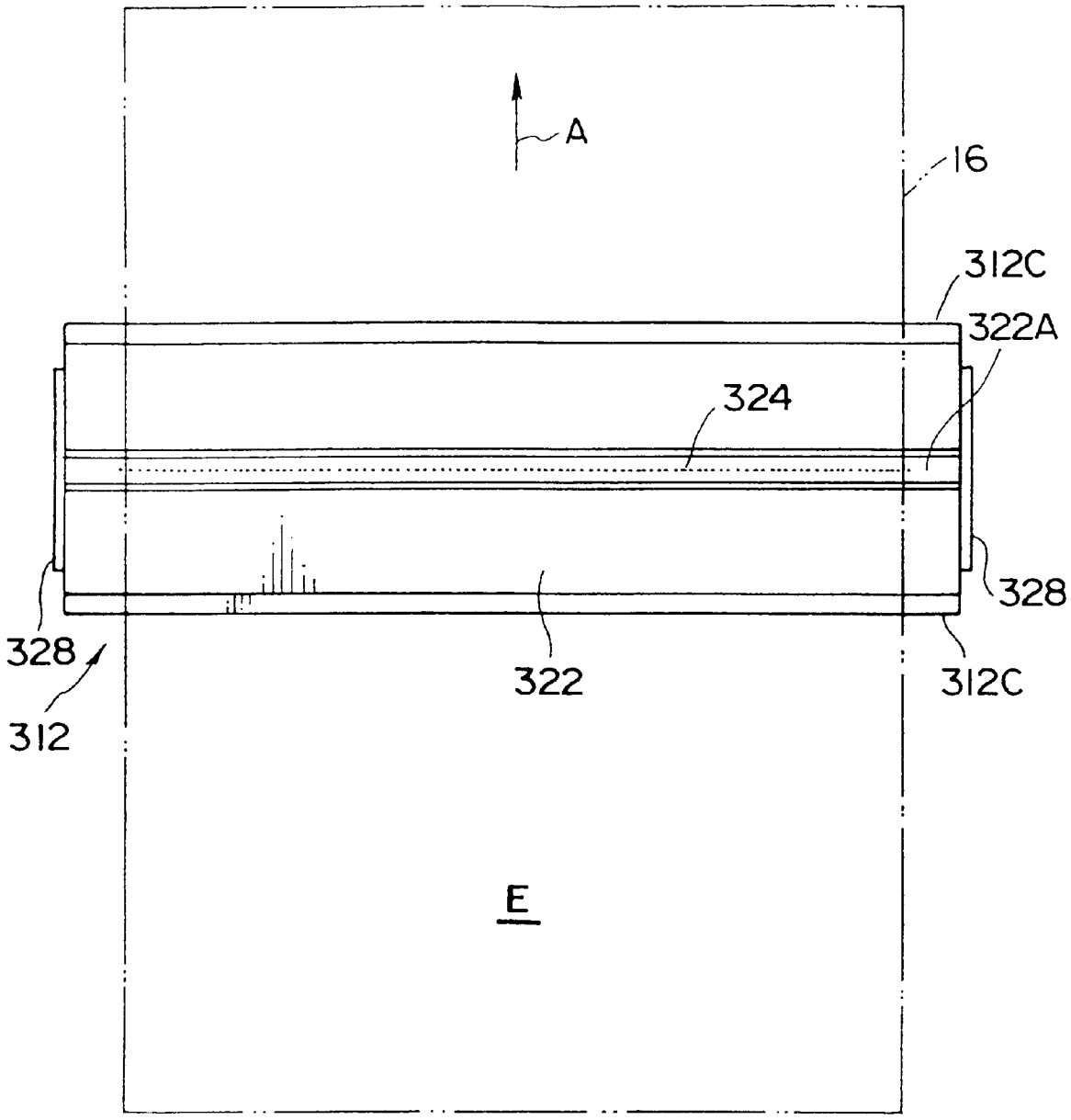
FIG. 4 is a bottom view of a state in which a photosensitive material is conveyed beneath the spray tank according to an embodiment of the present invention.
Figure 6:
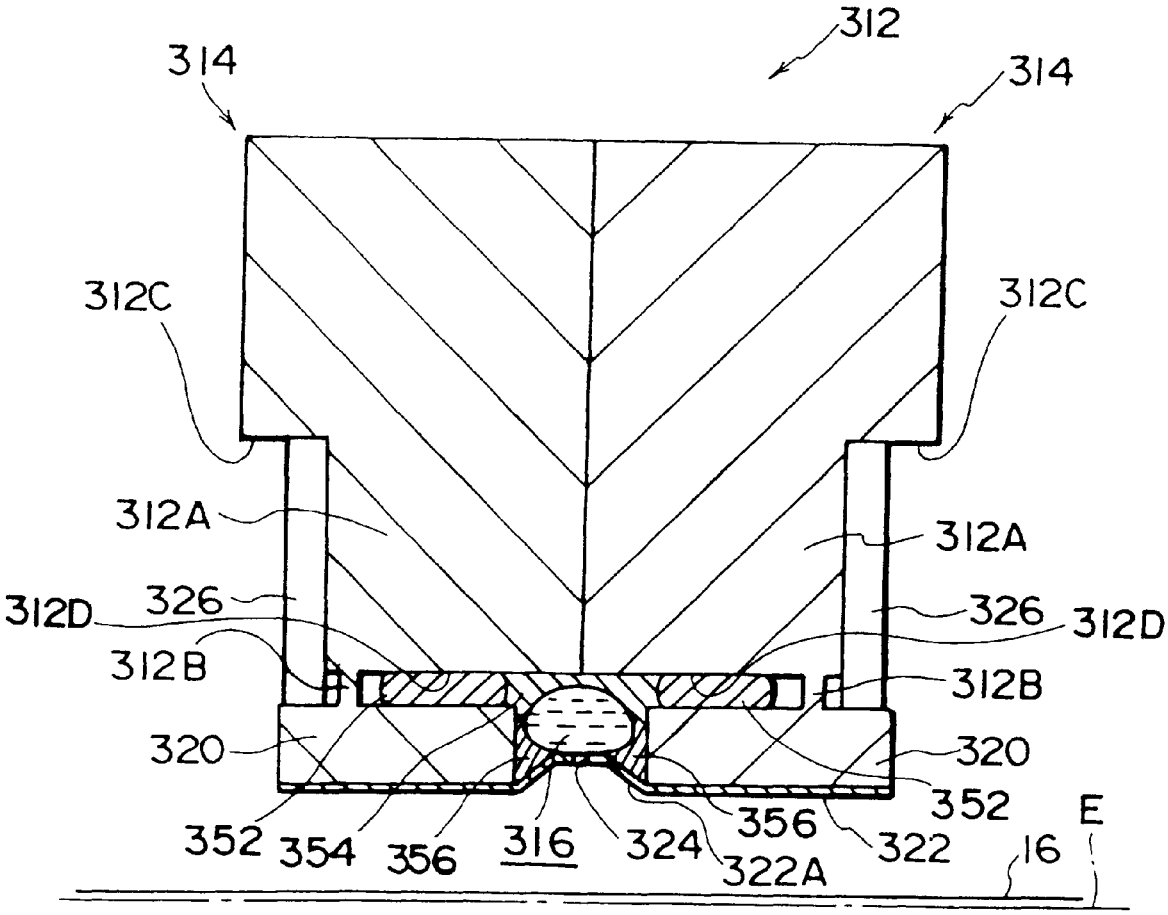
FIG. 6 is a cross sectional view of the spray tank according to an embodiment of the present invention.

As shown in FIGS. 4 and 6, a nozzle plate 322 made by an elastically deformable, rectangular, and thin plated plate member (e.g., a thickness of 60 μm or less) is disposed, at a portion which opposes the conveying path E of the photosensitive material 16, as a bottom wall surface forming a portion of the wall surface of this spray tank 312. Further, in the present embodiment, the nozzle plate 322 uses a nickel plate made by electro-forging.

Figure 3:
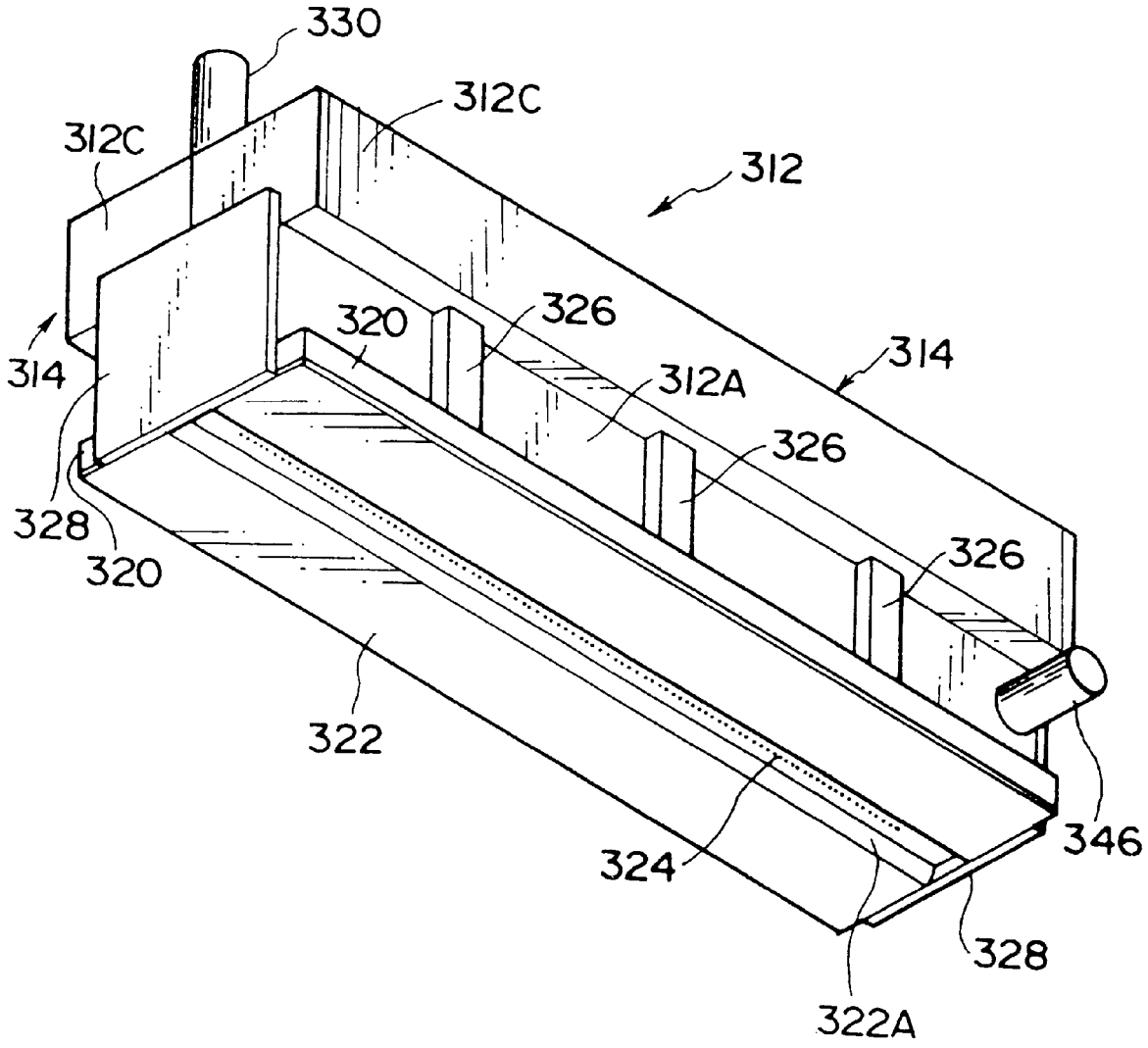
FIG. 3 is an enlarged perspective view of a spray tank according to an embodiment of the present invention.
Figure 5:
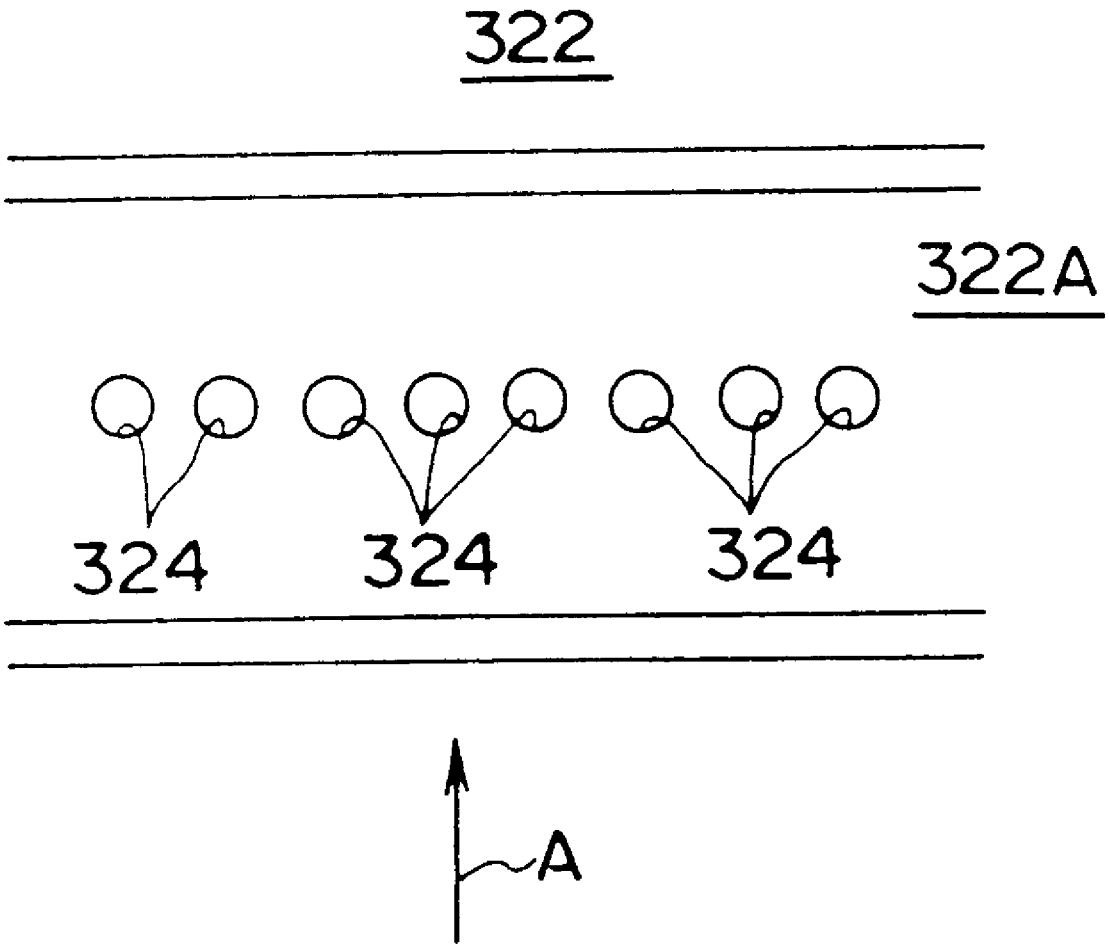
FIG. 5 is an enlarged view of a main portion in FIG. 4.

As shown in FIGS. 3 through 5, a plurality of nozzle holes 324 (each of which has a diameter of 10 μm to 200 μm, for example) form a straight line on this nozzle plate 322 and are spaced apart from each other at a predetermined distance along a direction orthogonal to the conveying direction A of the photosensitive material 16. A plurality of the nozzle holes 324 are disposed along the whole widthwise direction of the photosensitive material 16. For this reason, water, with which the spray tank 312 has been filled, can be sprayed from the nozzle holes 324 on the side of the photosensitive material 16.

In order to increase the rigidity of the nozzle plate 322 in the longitudinal direction thereof in which the nozzle holes 324 form a straight line, a concave portion 322A extending in a direction in which the nozzle holes 324 form a straight line is bent.

As shown in FIGS. 2 and 3, an exhaust pipe 330 extends from the upper portion of the spray tank 312 on the opposite side to the portion where the water supplying pipe 346 is connected. The exhaust pipe 330 connects the outside and inside portions of the spray tank 312. A valve (not shown) for opening or closing this exhaust pipe 330 is provided midway on the exhaust pipe 330, and the spray tank 312 can be opened or closed to the outside air by the opening or closing movement of this valve.

Both end portions of the nozzle plate 322, being the end portions of the nozzle plate which is positioned in an orthogonal direction with respect to the direction of the row of nozzles made up of the plurality of nozzle holes 324 arranged in a line, are bonded with an adhesive or the like respectively to a pair of lever plates 320, which serve as displacement transmitting members, as is shown in FIG. 6. Through this adhesive bonding, the nozzle plate 322 and a pair of the lever plates 320 are connected to each other. The pair of the lever plates 320 are respectively fixed to a pair of tank body structural members 312A via supporting portions 312B. Each of the supporting portions 312B has a narrow width and extends along a direction in which a plurality of the nozzle holes 324 form a straight line, and is provided at the lower wall portion of each of the tank body structural members 312A of the spray tank 312.

The pair of tank body structural members 312A have smooth facing surfaces which are abutted with no gap therebetween, and form an upper side portion of the spray tank 312. Further, step portions 312C protruding by a step from the spray tank 312 are provided on the pair of tank body structural members 312A, respectively. The spray tank 312 is formed into a configuration where the portions, above the midpoint of the spray tank 312 in a vertical direction, protrude.

A plurality of piezoelectric elements 326 serving as actuators (in this embodiment, three piezoelectric elements are provided on each side) are adhered to the lower side surfaces of the step portions 312C. The external end portions of each of the lever plates 320, being the portions of the lever plates 320 which are positioned on either side of the supporting members 312B with respect to the plurality of nozzle holes 324, are adhered to the lower surfaces of the piezoelectric elements 326. Accordingly, the piezoelectric elements 326 and the lever plates 320 are connected to each other.

As a result, a lever mechanism is formed by the piezoelectric elements 326, the lever plates 320, and the supporting portions 312B. Accordingly, a pair of recessed portions 312D inside which the lever plates 320 can swing are respectively provided between the pair of lever plates 320 and the pair of tank body structural members 312A. Each of the recessed portions 312D is filled with an elastic member 352 (for example, a silicon adhesive) formed from silicon rubber.

As described above, when the external end side portions of each of the lever plates 320 are moved by the piezoelectric elements 326, the lever plates 320 swing around each of the supporting portions 312B, while the internal end side portions of each of the lever plates 320 move in a reverse direction to the external end side portions of the lever plate 320. At this time, the elastic members 352 may be compressed or stretched in accordance with a swinging movement of the lever plate 320. However, they should not hinder the swinging of the elastically deformed lever plate 320.

The piezoelectric element 326 is made by, for example, laminated piezoelectric ceramics. Accordingly, the displacement in an axial direction of the piezoelectric element 326 is made large, and this piezoelectric element 326 is connected to a power source (not shown) through which the timing of voltage application can be controlled by a controller. The aforementioned valve for opening/closing the exhaust pipe 330 is also connected to this controller which then controls the opening/closing of the valve.

The lever plates 320, the tank body structural members 312A, and the supporting members 312B each form portions of the integrally formed frame 314. As shown in FIG. 6, the pair of frames 314 are fitted to each other and screwed together by bolts (not shown). Accordingly, the outer frame of the spray tank 312 is formed in a state in which the pair of lever plates 320, the pair of tank body structural members 312A, and the pair of supporting members 312B face each other, respectively. Further, the frame 314 is formed by an extrusion material molded through aluminum extrusion molding.

Figure 8:
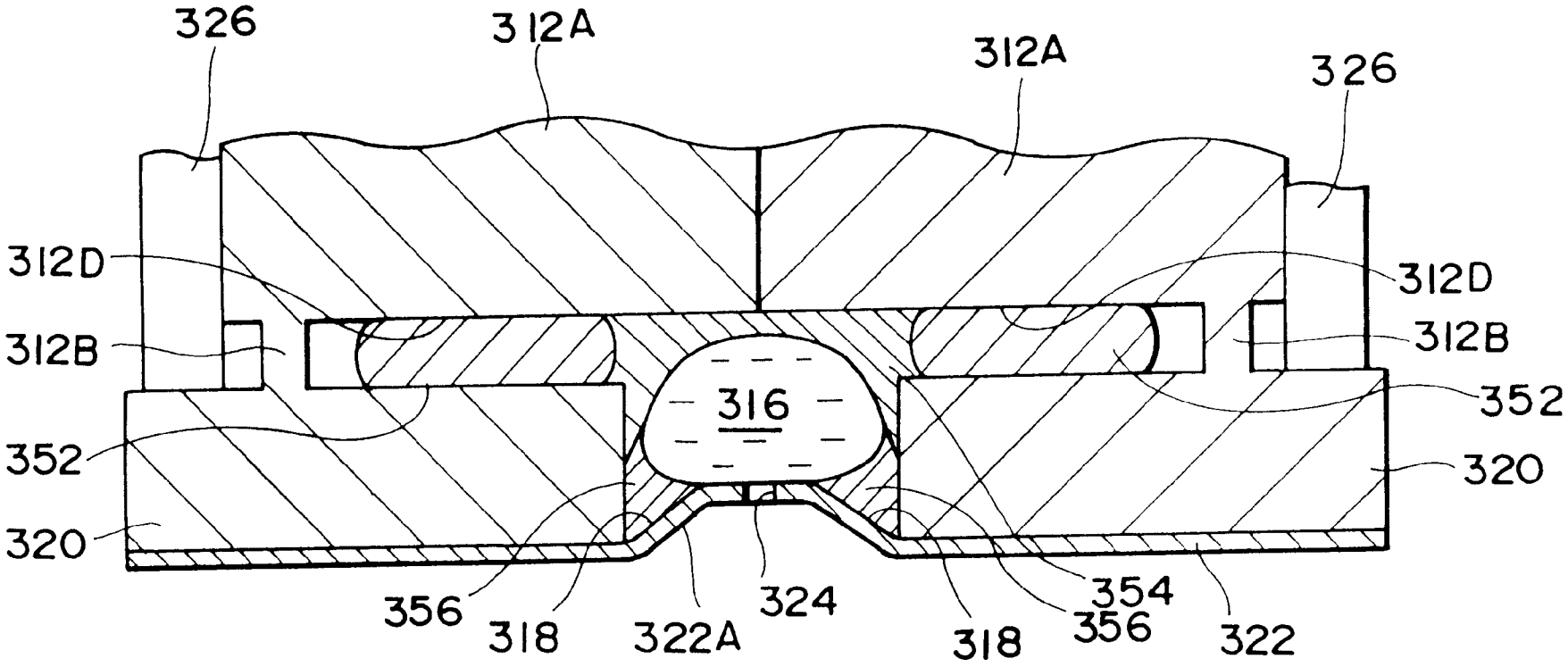
FIG. 8 is an enlarged cross sectional view of a main portion of the spray tank according to an embodiment of the present invention.

FIG. 8 is an enlarged view illustrating the main portion of the spray tank 312. As shown in this figure, in the spray tank 312, a space is formed between the tip end portions of a pair of the lever plates 320. This space has a substantially rectangular cross section, and is demarcated by the bottom surfaces of the pair of tank body structural members 312A, the tip end portions of the pair of lever plates 320, and the upper surface of the nozzle plate 322. A solvent storing space 316 is formed within the space and stores water therein.

This substantially rectangular space is filled with an elastic member 354 (silicon adhesive) made from silicone rubber so that a smooth free curve without concave or convex portions is created, and forms the internal wall surface of the solvent storing space 316. The sealing ability can be maintained on the periphery of the recessed portions 312D by this elastic member 354.

A pair of concave portions 318 is formed on a recessed portion 322A on the nozzle plate 322, each of which forms a part of the solvent storing space 316, between the upwardly protruding portions of the recessed portion 322A in FIG. 8 and the tip end surfaces of a pair of the lever plates 320.

Because the concave portions 318 are filled so that the surface bulges out slightly with surface-bonding adhesives 356 (e.g., thermoplastic seat adhesives), the lever plate 320 and the nozzle plate 322 are joined without any gaps. The internal wall surface of the solvent storing space 316 for storing water, is formed from the smooth curved surfaces of the surface-bonding adhesives 356 and the elastic member 354.

Namely, a filling material is formed by the elastic members 352 and 354 which can deform elastically and the surface-bonding adhesives 356, and the recessed portions 312D and the solvent storing space 316 are filled with an elastic material and a plastic material. Since the cross sectional configuration of the solvent storing space 316, which is shown in FIG. 6 and stores water from the spray tank 312, is similar to a smoothly curved circular pipe shape, it is difficult for air bubbles to be deposited on the internal portions of the spray tank 312.

Figures 9A, 9B, 9C:
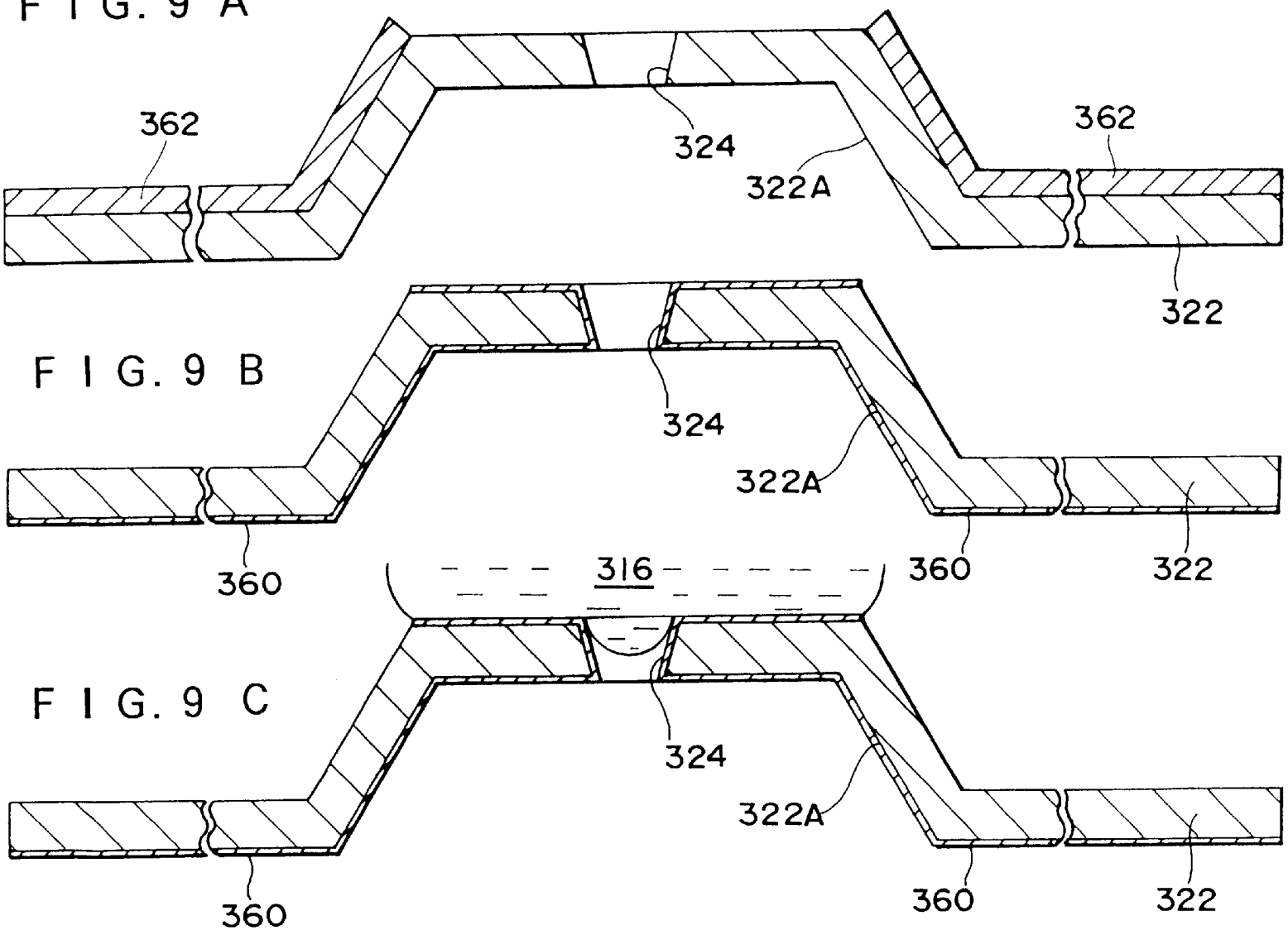
FIG. 9A is a cross sectional view of a surface treatment of a nozzle plate according to an embodiment of the present invention and illustrates a state in which masking tape is attached to the nozzle plate.
FIG. 9B is a cross sectional view of a surface treatment of the nozzle plate according to an embodiment of the present invention and illustrates a state in which a water repelling layer is provided on the nozzle plate.
FIG. 9C is a cross sectional view of a surface treatment of the nozzle plate according to an embodiment of the present invention and illustrates the nozzle plate when it is in use.

As shown in FIG. 9C, a water repelling layer 360 for repelling water is provided on the top and rear surfaces of the nozzle plate 322 at the peripheral portion of the nozzle holes 324, which includes the internal portion of the nozzle holes 324.

The water repelling layer 360 is made by co-precipitating nickel-phosphorus and PTFE (polytetrafluoroethylene resin) so as to have a thickness of, for example, 3 to 5 $\mu$m. Accordingly, the top and rear surfaces of the nozzle plate 322 at the peripheral portion of the nozzle holes 324 and the internal peripheral surfaces of the nozzle holes 324 are made water repellent by a polytetrafluoroethylene resin. For this reason, even when the water inside the solvent storing space 316 of the spray tank 312 has a positive pressure, for example, each of the nozzle holes 324 operates as a valve in order to dam the water.

Next, a process in which the water repelling layer 360 is adhered to the nozzle plate 322 is explained.

The thin-plate nozzle plate 322 is made by nickel electroforging. At this time, a plurality of extra fine nozzle holes 324 are pre-formed on the nozzle plate 322.

Next, as shown in FIG. 9A, in order to obtain an adhesive surface of the nozzle plate 322 which adheres to each of the lever plates 320, masking tape 362 which is heat and chemical resistant is attached to the respective end portions of the nozzle plate 322 on the side to be adhered to each of the lever plates 320. Thereafter, a plating process is effected.

In the plating process, an alcohol degreasing process, an acid washing process, and an alkali washing process are carried out sequentially. Thereafter, a co-precipitating plating process is effected in order to co-precipitate nickel-phosphorus and PTFE (polytetrafluoroethylene resin). As a result, a water repelling layer 360 being a plating layer is formed on the nozzle plate 322 except for the portions where the masking tape 362 has been attached.

Thereafter, a mask melting process is effected in order to detach the masking tape 362, and, after being in the state which is shown in FIG. 9, the nozzle plate 322 finally undergoes a heat processing in which the water repelling layer 360 is provided on the periphery of the nozzle holes 324, completing the formation of the nozzle plate 322.

Figure 10:
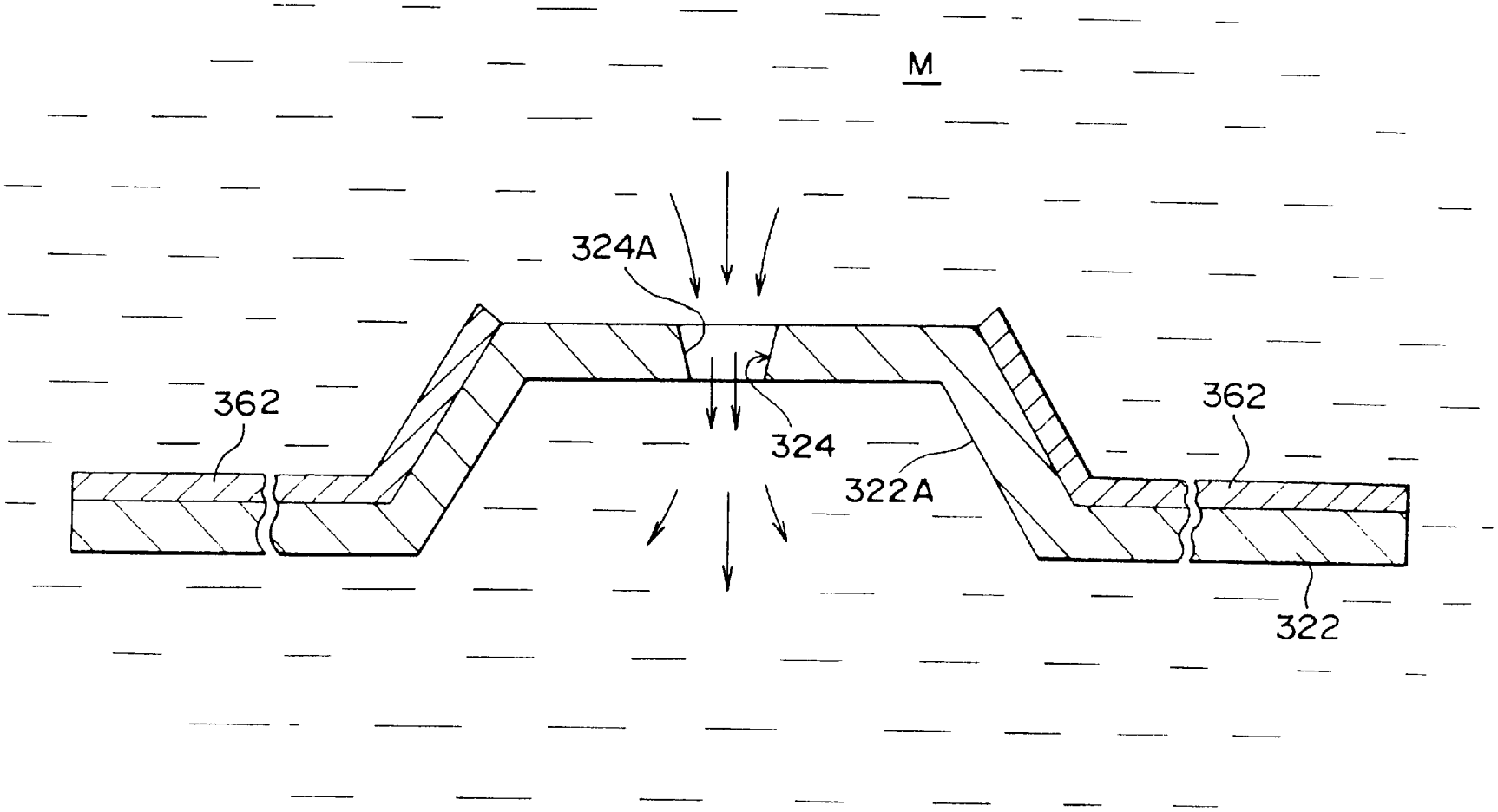
FIG. 10 is a cross sectional view of a plating process of the nozzle plate according to an embodiment of the present invention.

An ordinary electroless plating process is employed to effect this plating process. However, in this plating process, a plating liquid M is stirred, and as shown in FIG. 10, the plating liquid M is flushed into the nozzle holes 324 inside the plating process tank, and the plating liquid M is circulated inside the nozzle holes 324. As a result, fresh plating liquid M reaches the internal wall surface 324A of the nozzle holes 324, and the water repelling layer 360 which has been plated and which is deposited on the internal wall surfaces 324A of the nozzle holes 324 can be formed so as to have an uniform thickness.

The water repelling layer 360 having a thickness of less than or equal to 5 $\mu$m can be applied to the top and rear surfaces of the nozzle plate 322, and the water repelling layer 360 having a thickness which is substantially the same as the aforementioned can be applied stably and uniformly to the internal wall surface 324A of the nozzle holes 324.

As a result, factors causing the water repelling state of the internal wall surfaces of the nozzle holes 324 on which a plating process has been effected to vary can be eliminated, unnecessary leakage of water from the nozzle holes 324 can be prevented, and the direction of dispersion of the water droplets L can be made more stable, at the time of atomization of water.

Because the plating process tank is equipped with a strainer (not shown), dust can be removed, and deposition of dust into the nozzle holes 324 can be prevented during the plating process. Accordingly, the direction of dispersion of the water droplets L can be made more stable. A small amount of the plating liquid M is sufficient for circulating providing that the plating liquid M can be supplied into the nozzle holes 324.

Figures 11A, 11B, 11C:
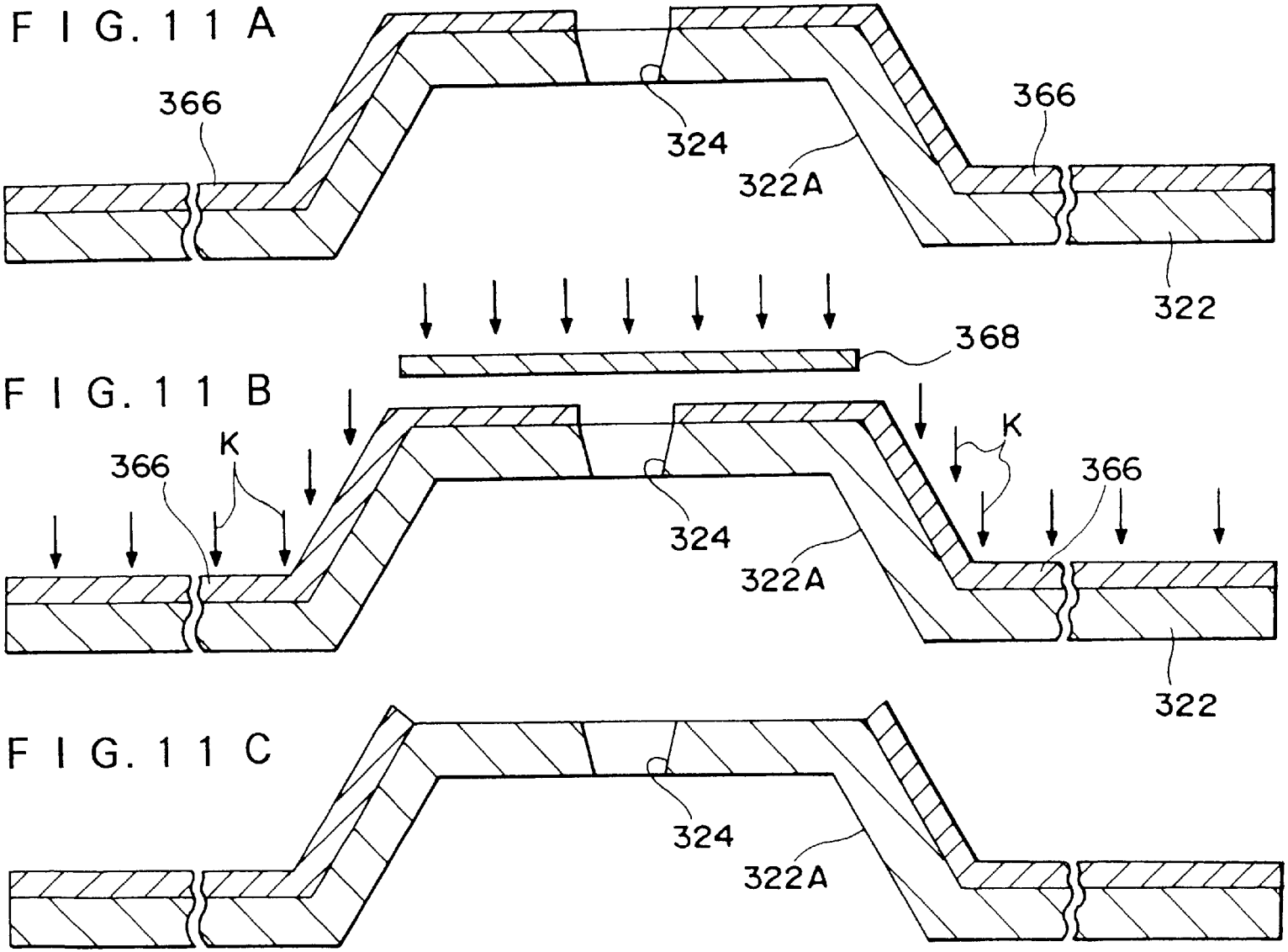
FIG. 11A is a cross sectional view of a surface treatment of the nozzle plate according to an embodiment of the present invention and illustrates a state in which a photoresist layer is formed.
FIG. 11B is a cross sectional view of a surface treatment of the nozzle plate according to an embodiment of the present invention and illustrates a state in which it is exposed to the nozzle plate.
FIG. 11C is a cross sectional view of a surface treatment of the nozzle plate according to an embodiment of the present invention and illustrates a state in which the masking has been completed.

As shown in FIG. 11A, separate to this, a layer of photoresist 366 is formed on the whole surface of the nozzle plate 322 on the surface of the side to be adhered to the lever plates 320. As shown in FIG. 11B, the nozzle plate 322 is exposed thereon, so that the surface of the nozzle plate 322, excepting the peripheral portions of the nozzle holes 324, is irradiated by the exposing light rays K. Further, as shown in FIG. 11C, masking can be effected on the nozzle plate 322 by eliminating unexposed portions of photoresist 366 by using a solvent. Thereafter, a plating process is effected in the same manner as described above.

As described above, since piezoelectric elements 326 are disposed in the spray tank 312, the nozzle plate 322 can oscillate uniformly and to a large degree along the direction in which the plurality of nozzle holes 324 form a straight line. For this reason, a vibration amplitude distributed uniformly along a widthwise direction of the photosensitive material 16, at which the water pressure at the peripheral portions of the nozzle holes 324 can be a pressure at which water can be atomized, can be provided. As a result, water can be sprayed and atomized substantially evenly from the plurality of nozzle holes 324 along the entire widthwise direction portion of the photosensitive layer 16.

As shown in FIGS. 3 and 4, at the portions which are demarcated by the longitudinal ends of the nozzle plate 322, being the end portions of the nozzle plate 322 which is positioned in the lengthswise direction of the row of nozzles formed by the nozzle holes 324, and the end portions of the pair of frames 314, thin sealing plates 328 are disposed in a state in which the thin sealing plates 328 are adhered to the pair of frames 314.

In order to fill the gap formed by the longitudinal ends of the nozzle plate 322, the end portions of the pair of frames 314, and the pair of sealing plates 328, and to prevent water from leaking from the aforementioned gap, the internal sides of sealing plates 328 are filled with an elastic adhesive such as a silicone rubber adhesive. Accordingly, the gaps within the spray tank 312 can be sealed with an elastic adhesive without hindering the movement of the longitudinal ends of the nozzle plate 322. Moreover, the longitudinal ends of the spray tank 312 may be sealed by an elastic adhesive only, without using the pair of in sealing plates 328.

Figure 7:
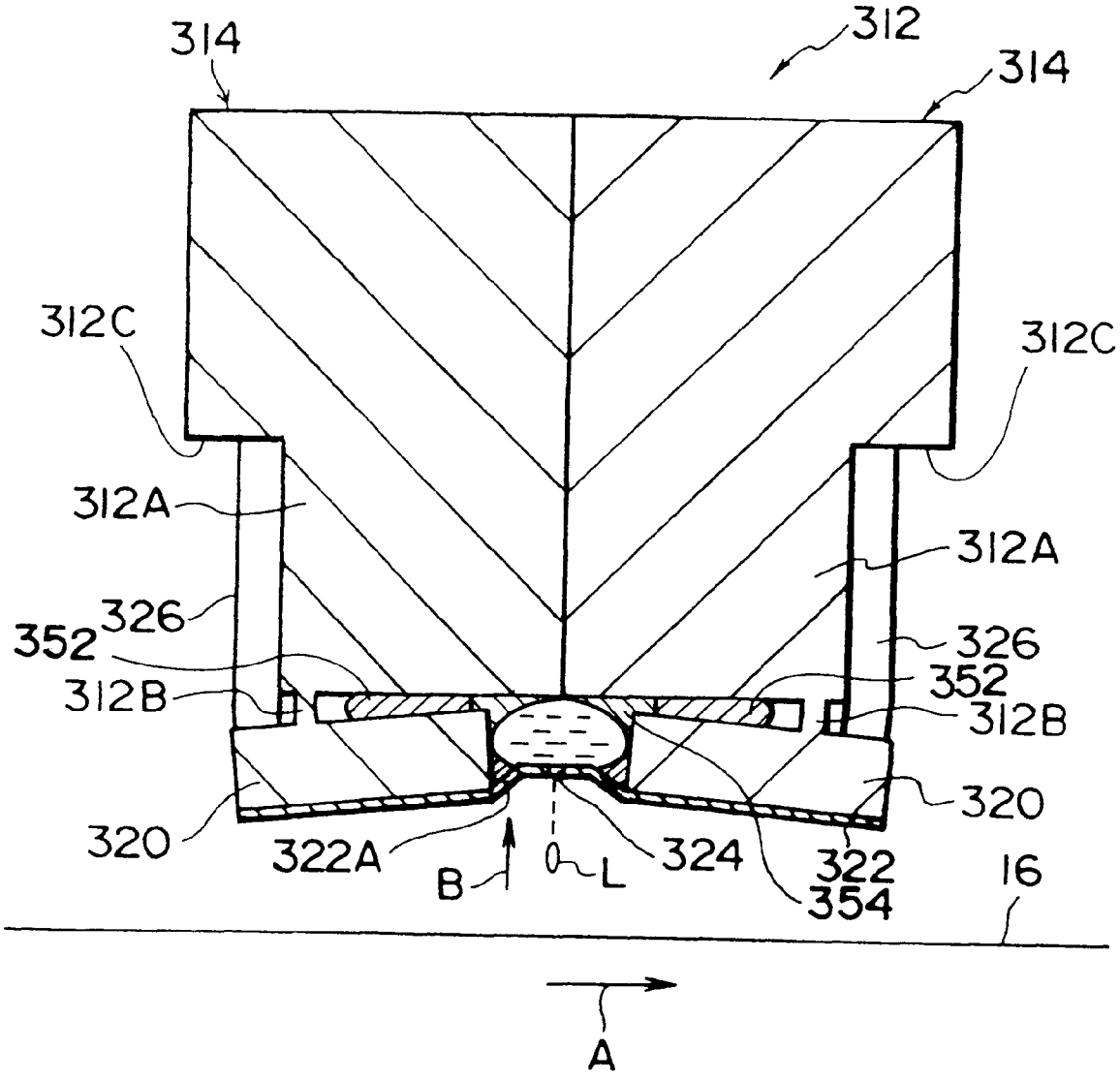
FIG. 7 is a cross sectional view of a state in which water is sprayed from the spray tank according to an embodiment of the present invention.

As described above, when the piezoelectric elements 326 are energized, as shown in FIG. 7, each of the piezoelectric elements 326 is extended so that each of the lever plates 320 is rotated axially around the respective supporting portions 312B. By this movement, the piezoelectric element 326 deforms and displaces the nozzle plate 322 via the lever plate 320 so as to move the central portion of the nozzle plate 322 upwards in the direction of arrow B. In accordance with the deformation of the nozzle plate 322, the water pressure in the spray tank 312 increases, and water droplets L, i.e., small amounts of water are sprayed collectively and linearly from each of the nozzle holes 324.

Further, water droplets L can be continuously sprayed from the nozzle holes 324 by repeating the energizing and extending of the piezoelectric elements 326.

As shown in FIG. 1, the image receiving material magazine 106 which receives the image receiving material 108 is disposed at the upper left end portion of the housing 12. A dye fixing material having a mordant is applied on the image forming surface of the image receiving material 108. The image receiving material 108 which has been pulled out from the image receiving material magazine 106 is rolled around the image receiving material magazine 106 so that the image forming surface of the image receiving material faces downwards.

In the vicinity of the image receiving material output portion of the image receiving material magazine 106, a pair of nip rollers 110 is provided. The nip rollers 110 nip the image receiving material 108 and pull out the image receiving material 108 from the image receiving material magazine 106, and cancel the nipping.

A cutter 112 is disposed at the side of the nip rollers 110. The cutter 112 is substantially the same as the cutter 112 for the photosensitive material as described above, for example, being formed by a stationary blade and a moving blade. For this reason, by moving the moving blade of the cutter 112 vertically by a rotation cam or the like, so that it meshes with the stationary blade of the cutter 112, the image receiving material 108 which has been pulled out from the image receiving material magazine 106 can be cut to a length which is shorter than the photosensitive material 16.

Conveying roller pairs 132, 134, 136, 138 and a guide plate (not shown) are disposed at the side of the cutter 112, and can convey to the heat developing and transferring section 120 the image receiving material 108 which has been cut to a predetermined length.

Figure 12:
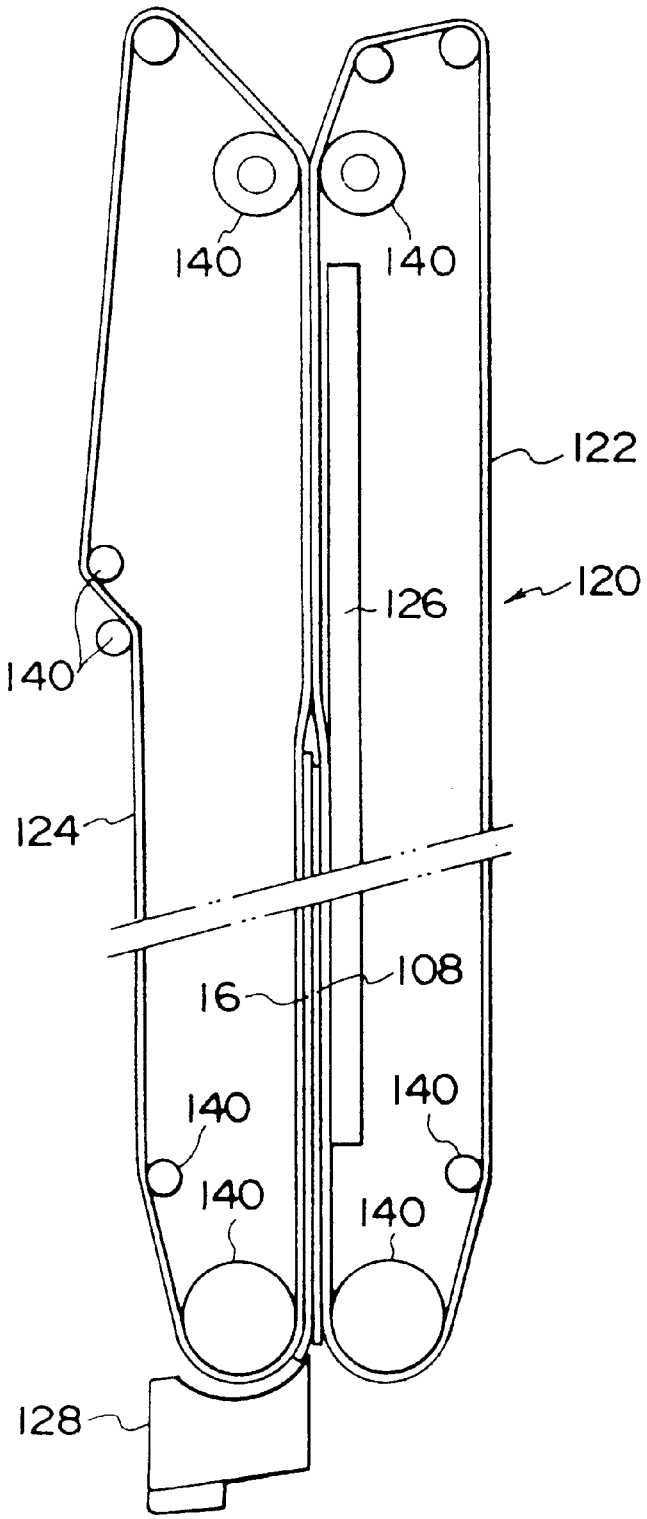
FIG. 12 is an enlarged view of a heat developing and transferring section according to an embodiment of the present invention.

As shown in FIGS. 1 and 12, the heat developing and transferring section 120 is wound around a plurality of pairs of winding rollers 140, respectively, and has a pair of the endless belts 122 and 124. Each of the endless belts 122 and 124 is formed in a looped shape whose vertical direction is a longitudinal direction. Accordingly, when one of the pairs of winding rollers 140 is driven and rotated, the pair of endless belts 122 and 124 which are wound around the winding rollers 140 are rotated, respectively.

In a loop of the endless belt 122 (at the upper right side in FIGS. 1 and 12) of the pair of endless belts 122 and 124, a heating plate 126 is formed in a plate shape whose vertical direction is a longitudinal direction. The heating plate 126 is disposed so as to face the internal left side peripheral portion of the endless belt 122. An unillustrated linear heater is provided in the internal portion of the heat plate 126. The surface temperature of the heating plate 126 is raised by this heater. As a result, the surface of the heating plate 126 can be maintained at a predetermined temperature.

Accordingly, the photosensitive material 16 is conveyed by the pair of conveying rollers 34 into the pair of endless belts 122 and 124 at the heat developing and transferring section 120 at the end of the conveying path. Further, the conveyance of the image receiving material 108 is synchronized with the conveyance of the photosensitive material 16. In a state in which the photosensitive material 16 is conveyed prior to the image receiving material 108 by a predetermined length, the image receiving material 108 is conveyed by a pair of conveying rollers 138 at the end of the conveying path into the pair of endless belts 122 and 124 at the heat developing and transferring section 120, and is laminated with the photosensitive material 16.

In this case, the image receiving material 108 has widthwise and lengthwise dimensions which are smaller than those of the photosensitive material 16. Accordingly, when the photosensitive material 16 is laminated with the image receiving material 108, the four sides of the periphery of the photosensitive material 16 project from those of the periphery of the image receiving material 108.

As described above, the photosensitive material 16 and the image receiving material 108 which have been laminated to each other by the pair of endless belts 122 and 124 are nipped and conveyed by the endless belts 122 and 124 in a laminated state. When the laminated photosensitive material 16 and the image receiving material 108 have been completely entered into the endless belts 122 and 124, the pair of endless belts 122 and 124 stops rotating temporarily and the nipped photosensitive material 16 and image receiving material 108 are heated by the heating plate 126. During the time at which the photosensitive material 16 is nipped and conveyed, and is stopped, it is being heated through the endless belt 122 and the heating plate 126. Together with the heating, the photosensitive material 16 discharges a movable dye. At the same time, the dye is transferred to a dye fixing layer of the image receiving material 108, and an image is formed on the image receiving material 108.

On the downstream side in the direction the material is fed, of the pair of endless belts 122 and 124, a peel-off pawl 128 is disposed. For this reason, the peel-off pawl 128 can engage the front edge portion of the photosensitive material 16 only out of the photosensitive material 16 and the image receiving material 108 which are nipped and conveyed between the pair of endless belts 122 and 124, and peels the front edge portion of the photosensitive material 16, which protrudes from between the pair of endless belts 122 and 124, from the image receiving material 108.

At the left side of the peel-off pawl 128, photosensitive material discharging rollers 148 are disposed. The photosensitive material 16 is moved to the left by being guided by the peel-off pawl 128, and can be conveyed to the side of a discharged photosensitive material accommodating section 150.

The discharged photosensitive material accommodating section 150 has a drum 152 around which the photosensitive material 16 is rolled, and has a belt 154, a portion of which is rolled around the drum 152. The belt 154 is rolled around a plurality of rollers 156, and moves through the rotation of the rollers 156. In accordance with this, the drum 152 can rotate.

Therefore, in a state in which the belt 154 is conveyed due to the rotation of the rollers 156, when the photosensitive material 16 is fed into the rollers 156, the photosensitive material 16 can be collected around the drum 152.

In FIG. 1, receiving material discharge rollers 162, 164, 166, 168, 170 are sequentially disposed in order to convey the image receiving material 108 from the bottom of the pair of endless belts 122 and 124 to the left. For this reason, the image receiving material 108 which has been discharged from the pair of endless belts 122 and 124 is conveyed by the receiving material discharging rollers 162, 164, 166, 168, 170, and discharged into a tray 172.

Next, operation of a first embodiment of the present invention will be explained.

In the image recording device 10 which is structured as described above, after the photosensitive material magazine 14 has been set, nip rollers 18 are operated and the photosensitive material 16 is pulled out by the pair of nip rollers 18. When a predetermined length of the photosensitive material 16 is pulled out, the cutter 20 is operated and the photosensitive material 16 is cut to a predetermined length and conveyed to the exposure section 22 in a state in which the photosensitive (exposure) surface is facing to the left. The exposure device 38 is operated while the photosensitive material 16 passes through the exposure section 22, and an image is scanned and exposed to the photosensitive material 16 which is positioned at the exposure section 22.

When the exposure has been completed, the exposed photosensitive material 16 is forwarded to the water application section 50. In the water application section 50, the conveyed photosensitive material 16 is fed to the side of the spray tank 312 through the driving of the conveying rollers 32 as shown in FIG. 4.

The movement and operation of the photosensitive material 16 during which the photosensitive material 16 which is conveyed along the conveying path E is deposited with water from the spray tank 312 will now be explained.

The spray tank 312 storing water therein is provided at the upper portion of the conveying path E so as to face the conveying path E of the photosensitive material 16. The nozzle plate 322 in which the plurality of nozzle holes 324 for spraying form a straight line is provided as the bottom wall surface of the spray tank 312 facing the conveying path E of the photosensitive material 16.

Further, a pair of elongated lever plates 320 are respectively connected to portions at the end sides of the nozzle plate 322 in a direction orthogonal to the direction in which the plurality of nozzle holes 324 form a straight line. The pair of lever plates 320 are supported so as to be able to swing around a pair of supporting portions 312B extending along a direction in which a plurality of the nozzle holes 324 form a line.

When water is sprayed from the spray tank 312, a pump 336 is operated and the spray tank 312 is filled with water fed from the water bottle 332 through a filter 334, a sub tank 338, a water supplying pipe 346 or the like. Thus, the spray tank 312 is filled with water which is stored therein. Thereafter, the controller closes the valve of the discharging tube 330.

When the spray tank 312 is filled with water, the water pressure may vary, and the water pressure within the spray tank 312 may be a higher positive pressure than the outside air pressure. However, the water repelling layer 360 for repelling water is provided on the nozzle plate 322 including the internal portions of the nozzle holes 324, and the peripheral portions of the nozzle holes 324. A description thereof will now be given.

Namely, the nozzle plate 322 forms a portion of the wall surface of the solvent storing space 316 in the spray tank 312. The water repelling layer 360 for repelling water is provided on the periphery of the nozzle holes 324 of the nozzle plate 322. Accordingly, even if the water pressure within the spray tank 312 is in a positive pressure, the water repelling layer 360 on the periphery of the nozzle holes 324 repels water and serves as a valve which dams the water. As a result, water is prevented from leaking from the spray tank 312.

When the water is atomized and sprayed, a voltage is applied to the piezoelectric elements 326 through a power source controlled by a controller in order to elongate all of the piezoelectric elements 326 simultaneously.

When the plurality of piezoelectric elements 326 expand so as to all be extended at the same time, the pair of lever plates 320 are swung around the respective supporting portions 312B, and the portion of the nozzle plate 322 surrounding the nozzle holes 324 is reciprocated above the conveying path E in a direction facing the photosensitive material 16, (in this case, the portion of the nozzle plate 322 moves in the direction of arrow B in FIG. 7), and the nozzle plate 322 pressurizes the water within the solvent storing space 316 of the spray tank 312.

As described above, together with the movement of the piezoelectric elements 326, the water with which the solvent storing space 316 is filled, is sprayed from the plurality of nozzle holes 324. As a result, as shown in FIG. 7, the water with which the spray tank 312 has been filled, is sprayed and atomized from the nozzle holes 324 and can be deposited on the photosensitive material 16 during the conveyance thereof.

As a result, water can be uniformly applied to the top surface of the photosensitive material 16 by the spray tank 312 which does not contact the photosensitive material 16.

Together with the movement of the piezoelectric elements 326, the lever plates 320 swing around their respective supporting portions 312B which extend in the direction in which the plurality of nozzle holes 324 form a straight line. Accordingly, the whole portion of the nozzle plate 322 having the plurality of nozzle holes 324 displaces uniformly.

For this reason, along the longitudinal direction in which a plurality of the nozzle holes 324 form a straight line, all the nozzle holes 324 can be displaced by the same, stably fixed displacement amount, and the water, with which the spray tank 312 has been filled, is sprayed evenly from the plurality of nozzle holes 324. Therefore, it is difficult for areas of the photosensitive material 16 to remain untouched by water.

The spray tank 312 has the nozzle holes 324 and water is sprayed from the nozzle holes 324. Accordingly, as compared to application devices in which a photosensitive material or the like is dipped in a tank storing water therein and water is applied thereto, a smaller amount of water is enough for the application of the photosensitive material 16, and the photosensitive material 16 can dry in a shorter period of time.

The spray tank 312 has a plurality of the nozzle holes 324 which are disposed across the entire widthwise direction of the photosensitive material 16. Through one displacement of the plurality of nozzle holes 324 by the piezoelectric elements 326, water can be sprayed from the nozzle holes, simultaneously. Accordingly, through one spraying, water can be applied to a broad range of the photosensitive material 16 across the entire widthwise direction thereof. As a result, it is no longer necessary to scan the nozzle plate 322 on a two-dimensional plane, and water can be applied to a larger area of the photosensitive material 16 in a short period of time, thereby minimizing the application time.

In combination with the speed at which the photosensitive material 16 is conveyed, water can be applied to the entire surface of the photosensitive material 16 by spraying water from the nozzle holes 324 for a multiple number of times at an arbitrary timing. When water is sprayed from the nozzle holes 324 of the nozzle plate 322, the amount of water within the spray tank 312 gradually decreases. However, because a sub tank 338 can supply water into the spray tank 312 and maintain the water in the spray tank 312 at a constant level, water is supplied from the sub tank 338 to the spray tank 312, and the water pressure of the water in the tank 312 during atomization can be maintained at a fixed value. Accordingly, a continuous spray of water can be maintained.

Thereafter, the photosensitive material 16, to which water as an image forming solvent has been applied at the water application section 50, is conveyed between the pair of the endless belts 122 and 124 in the heat developing and transferring section 120 by the pair of conveying rollers 34.

As an image is scanned and exposed to the photosensitive material 16, the image receiving material 108 is pulled out from the image receiving material magazine 106 and conveyed by the pair of nip rollers 110. When a predetermined length of the image receiving material 108 is pulled out, the cutter 112 cuts the image receiving material 108 to a desired length.

After the operation of the cutter 112, the cut image receiving material 108 is conveyed by the conveying rollers 132, 134, 136, 138 while the cut image receiving material 108 is being guided by a guide plate. When the front edge portion of the image receiving material 108 is nipped by the conveying rollers 138, the image receiving material 108 is set in a waiting state immediately before the heat developing and transferring section 120.

As described above, as the photosensitive material 16 is conveyed onto the endless belts 122 and 124, the conveying of the image receiving material 108 is restarted, and the image receiving material 108 and the photosensitive material 16 are conveyed between the endless belts 122 and 124, and are integrated with each other.

As a result, the photosensitive material 16 and the image receiving material 108 are laminated with each other, and nipped and conveyed while being heated by the heating plate 126. Accordingly, a heat developing and transferring process is carried out, and an image is formed on the image receiving material 108.

When the photosensitive material 16 and the image receiving material 108 are discharged from the pair of endless belts 122 and 124, the peel-off pawl 128 engages with the front edge portion of the photosensitive material 16 which is conveyed ahead of the image receiving material 108 by a predetermined length, and the leading edge of the photosensitive material 16 is peeled away from the image receiving material 108. The photosensitive material 16 is also conveyed by the photosensitive material discharging rollers 148 and is collected in the discharged photosensitive material accommodating section 150. At this time, since the photosensitive material 16 dries immediately, there is no need to provide a heater or the like in order to dry the photosensitive material 16.

The image receiving material 108 which has been separated from the photosensitive material 16 is conveyed by the image receiving material discharging rollers 162, 164, 166, 168, 170 and output to the tray 172.

When a plurality of images are recorded on an image recording material through an image recording process, the processes described as below are sequentially effected.

As described above, the image receiving material 108, which has been nipped by the pair of endless belts 122 and 124 and has been subjected to the heat developing and transferring process, and on which a predetermined image has been formed (recorded), is output from the pair of the endless belts 122 and 124. Thereafter, the image receiving material 108 is nipped and conveyed by the image receiving material discharging rollers 162, 164, 166, 168, 170 and is taken out from the image recording device.

Figure 13:
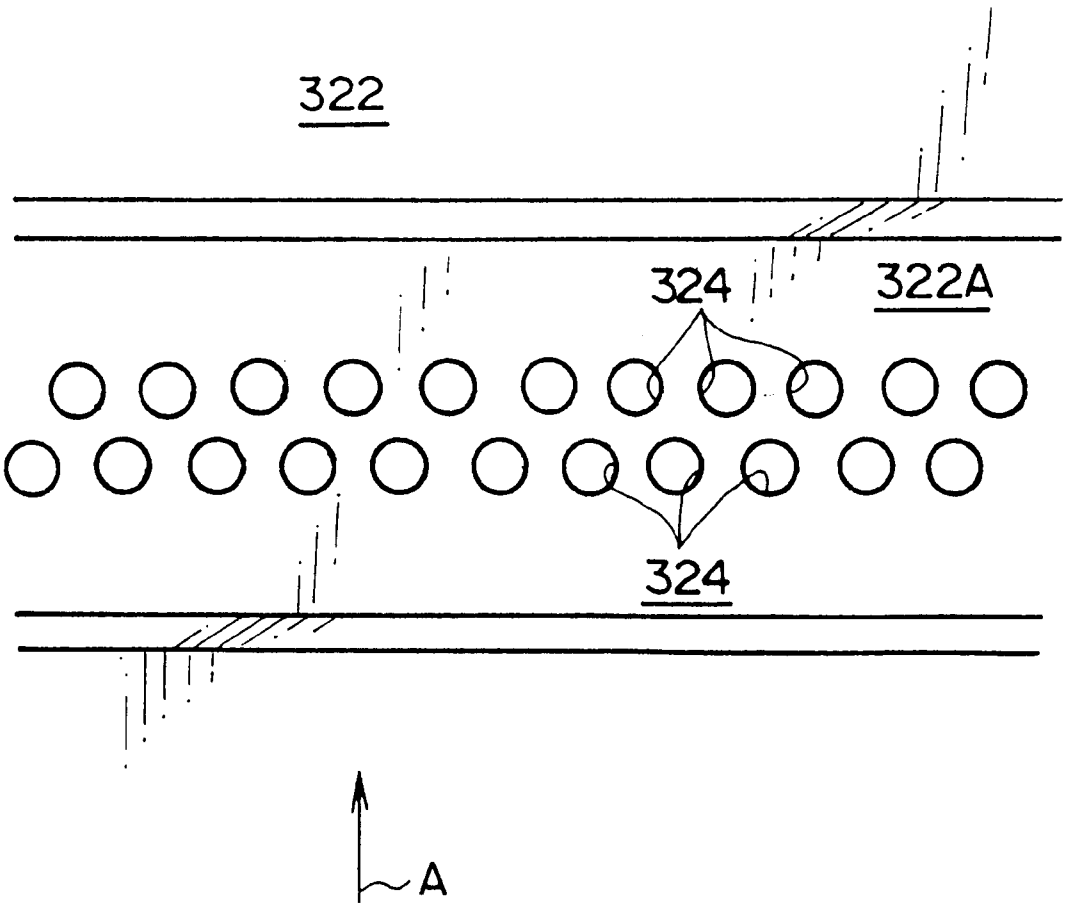
FIG. 13 is an enlarged view of a main portion illustrating the arrangement of nozzle holes in a spray tank according to a second embodiment of the present invention.

Next, an enlarged view of the nozzle plate 322 in the spray tank 312 according to a second embodiment of the present invention is shown in FIG. 13, and a description thereof will now be given. Further, portions identical to those shown in the first embodiment are denoted by the same reference numerals, and a description thereof will be omitted.

As shown FIG. 13, two staggered lines of nozzle holes for spraying water, lined up with a fixed distance therebetween in a straight line, in an orthogonal direction with respect to the conveying direction A of the photosensitive material 16, are disposed on the nozzle plate 322 of the spray tank 312 according to the present embodiment.

Operations and effects which are similar to the first embodiment can be provided by lining up the nozzle holes 324 as described above. In addition, one spray of solvent allows for the application from two nozzle lines. Accordingly, the number of expansions of the piezoelectric elements 326 can be reduced, leading to a more efficient application becoming possible.

In the above-described first and second embodiments, the nozzle plate 322 is made by nickel electro-forging, and the water repelling layer 360 is a layer which is made by co-precipitating nickel-phosphor and polytetrafluoroethylene. However, it is not limited to this combination of materials. For example, the material of the nozzle plate 322 may be a metal such as stainless steel or the like, ceramics, silicone, glass, plastic or the like. The water repelling layer 360 may use a material such as a high polymer fluoride, a material which satisfies water repellency, or the like. Namely, it is desirable that the combination of materials prevents the nozzle plate and water repelling layer from peeling off from each other, while the surface of a water repelling layer is water repellent.

The thickness of the water repellent processing layer 360 is, for example, 3 to 5 $\mu$m. However, It is not limited to this value. Further, in accordance with the above-described embodiments, a water repellent processing layer is provided for the entire periphery of the nozzle holes. However, in cases where the water repellent processing layer is provided only on the internal portion of the nozzle hole, because operations and effects which are substantially the same as those in the first and second embodiments can be provided, the water repellent processing layer may be provided only on the internal portion of the nozzle holes. Further, the water repellent processing layer may be provided on the periphery of the nozzle holes excluding the portion of the nozzle plate on the internal side of the spray tank.

In accordance with the above-described first and second embodiments, 1 or 2 nozzle lines were provided, however, the number of nozzle lines are not limited to one or two. Accordingly, three or more nozzle lines can be formed. The larger the number of nozzle lines, the fewer the times the actuator is driven.

Further, in accordance with the first and second embodiments, the rows of nozzles are disposed orthogonally to the conveying direction of the photosensitive material 16, however, they are not limited to this orthogonal disposition, and may be disposed diagonally to the conveying direction of the photosensitive material 16.

In accordance with the above-described first and second embodiments, the photosensitive material 16 and the image receiving material 108 are used as an image recording material. Water is applied to the photosensitive material 16, after the exposure thereof, by the spray tank 312 of the application device 310. The photosensitive material 16 and the image receiving material 108 are laminated onto each other and are subjected to the heat developing and transferring process. However, the structure is not limited to this, and water may be applied by spraying to the image receiving material 108.

Further, an image recording material according to the present invention is not limited to the materials used in the above described embodiments. Sheet type or roll type materials can be used where suitable. The image forming solvent may be a solvent other than water. Moreover, the present invention can be employed for the application of a developer to printing paper in a developing machine, the application of dipping water in a printer, and in coating machines or the like.

As described above, in accordance with the liquid spraying apparatus and the method of manufacturing the liquid spraying apparatus of the present invention, the superior effect of the image forming solvent being prevented from leaking from nozzle holes unnecessarily can be obtained.

What is claimed is:

1. A liquid spraying apparatus which is used for an image forming apparatus and sprays an image forming solvent onto an image recording material, comprising:

a spray tank which stores the image forming solvent;

a nozzle plate with a plurality of nozzle holes connected to said spray tank for spraying the image forming solvent formed thereon, which can spray the image forming solvent from the plurality of nozzle holes by a reciprocating movement, said nozzle plate having an internal surface and an external surface, said external surface including a first portion which lies in a plane and a second portion which is bent from said first portion so as to be out of said plane, wherein each of said nozzle holes extends from said internal surface to said external surface; and a water repelling layer which is provided at the internal periphery of the nozzle holes of said nozzle plate for repelling the image forming solvent;

wherein said nozzle plate has a concave portion which is formed in a bent shape so that the rigidity of said nozzle plate increases.

2. A liquid spraying apparatus according to claim 1, wherein said internal surface of said nozzle plate is disposed on said spray tank as a portion of the wall surface of said spray tank.

3. A liquid spraying apparatus according to claim 1, wherein said water repelling layer is further provided on the periphery of the nozzle holes of said nozzle plate on an external side of said spray tank.

4. A liquid spraying apparatus according to claim 3, wherein said water repelling layer is further provided on said internal surface of said nozzle plate around the nozzle holes of said nozzle plate.

5. A liquid spraying apparatus according to claim 1, wherein a solvent storing space in said spray tank for storing the image forming solvent has a smoothly curved cross sectional configuration so that it is difficult for air bubbles to be deposited.

6. A liquid spraying apparatus according to claim 1, wherein at least one of said nozzle holes has a diameter on said internal surface which is larger than that on said external surface.

7. A liquid spraying apparatus according to claim 1, wherein said nozzle plate has a row of nozzle holes formed in a straight line thereon.

8. A liquid spraying apparatus according to claim 7, wherein said nozzle plate has a plurality of rows of nozzle holes formed in a straight line thereon, and the rows of nozzle holes are formed in a offset from one another.

9. A liquid spraying apparatus according to claim 1, further comprising an actuator by which said nozzle plate is reciprocated.

10. A liquid spraying apparatus according to claim 9, wherein said water repelling layer is further provided on the periphery of the nozzle holes of said nozzle plate on an external side of said spray tank.

11. A liquid spraying apparatus according to claim 10, wherein said water repelling layer is further provided on said internal surface of said nozzle plate around the nozzle holes of said nozzle plate.

12. A liquid spraying apparatus according to claim 9, wherein said spray tank further includes at least one tank body structural member, and at least one lever plate connected to said at least one tank body structural member by a supporting portion, such that said at least one lever plate is pivotable about said supporting portion.

13. A liquid spraying apparatus according to claim 12, wherein said actuator includes a piezoelectric member connected between said at least one tank body structural member and said at least one lever plate.

14. A liquid spraying apparatus according to claim 12, wherein said nozzle plate is connected to said at least one lever plate.

15. A liquid spraying apparatus according to claim 1, wherein said water repellant layer is further provided on said inner surface of said nozzle plate around the nozzle holes of said nozzle plate.

16. A liquid spraying apparatus according to claim 5, wherein said solvent storing space is defined by a surface bonding member on said internal surface of said nozzle plate.

17. A liquid spraying apparatus according to claim 16, wherein said solvent storing space is further defined by an elastic member connected to said bonding member such that said solvent storing space is formed between said bonding member and said elastic member.

18. A liquid spraying apparatus according to claim 1, wherein at least one of said nozzle holes is tapered.

19. A liquid spraying apparatus according to claim 1, wherein at least one of said nozzle holes has a diameter on said internal surface which is larger than that on said external surface.

20. A liquid spraying apparatus according to claim 14, wherein said actuator includes a piezoelectric member connected between said at least one tank body structural member and said at least one lever plate.

21. A liquid spraying apparatus according to claim 1, wherein said second portion of said external surface of said nozzle plate is recessed from said first portion.

22. A liquid spraying apparatus according to claim 21, wherein said second portion includes a first surface which lies in a plane which is parallel to that of said first portion.

23. A liquid spraying apparatus according to claim 22, wherein said nozzle holes are located on said first surface of said second portion.

24. A liquid spraying apparatus according to claim 1, wherein said second portion of said external surface of said nozzle plate is recessed from said first portion.

25. A liquid spraying apparatus according to claim 24, wherein said concave portion is formed between said first portion and said second portion.

26. A liquid spraying apparatus according to claim 25, wherein said solvent storing space is defined by a surface bonding member on said internal surface of said nozzle plate.

27. A liquid spraying apparatus according to claim 26, wherein said solvent storing space is further defined by an elastic member connected to said bonding member such that said solvent storing space is formed between said bonding member and said elastic member.

28. A liquid spraying apparatus which is used for an image forming apparatus and sprays an image forming solvent onto an image recording material, comprising:

a spray tank which stores the image forming solvent, said spray tank including at least one tank body structural member, and at least one lever plate connected to said at least one tank body structural member by a supporting portion, such that said at least one lever plate is pivotable about said supporting portion;

a nozzle plate with a plurality of nozzle holes connected to said spray tank for spraying the image forming solvent formed thereon, which can spray the image forming solvent from the plurality of nozzle holes by a reciprocating movement, said nozzle plate having an internal surface and an external surface, wherein each of said nozzle holes extends from said internal surface to said external surface and said nozzle plate has a concave portion which is formed in a bent shape so that the rigidity of said nozzle plate increases;

a water repelling layer which is provided at the internal periphery of the nozzle holes of said nozzle plate for repelling the image forming solvent; and an actuator by which said nozzle plate is reciprocated.

* * * * *

UNITED STATES PATENT AND TRADEMARK OFFICE

CERTIFICATE OF CORRECTION

PATENT NO. : 6,036,105
APPLICATION NO. : 09/032759
DATED : March 14, 2000
INVENTOR(S) : Kazuo Sanada and Hiroshi Inoue It is certified that error appears in the above-identified patent and that said Letters Patent is hereby corrected as shown below:

On title page Item [56] References Cited

U.S. Patent Documents

| | | | |
|---|---|---|---|
| 5,387,440 | 2/1995 | Takemoto et al. | 347/45X |
| 5,502,470 | 3/1996 | Miyashita et al. | 347/45X |
| 5,653,901 | 8/1997 | Yoshimura | 347/45X |
| 5,746,373 | 5/1998 | Sanada | 239/102.2 |
| 5,759,421 | 6/1998 | Takemoto et al. | 347/45X |

Signed and Sealed this

Seventeenth Day of July, 2007

JON W. DUDAS
*Director of the United States Patent and Trademark Office*